US006148732A

United States Patent [19]

Conway et al.

[11] Patent Number: 6,148,732

[45] Date of Patent: Nov. 21, 2000

[54] RAILCAR TRACK CLEANING SYSTEM

[75] Inventors: Ronald K. Conway, North Charleston; Donald C. Bailey, Summerville, both of S.C.

[73] Assignee: Carolina Equipment & Supply Company, Inc., North Charleston, S.C.

[21] Appl. No.: 09/163,564

[22] Filed: Sep. 30, 1998

(Under 37 CFR 1.47)

[51] Int. Cl.[7] ..... B61F 19/00

[52] U.S. Cl. ..... 104/279; 15/55; 239/136; 239/174

[58] Field of Search ..... 104/279; 134/131, 134/144, 151, 167 R, 102.1; 15/239, 300.1, 55; 239/136, 174

[56] References Cited

U.S. PATENT DOCUMENTS

| | | | |
|---|---|---|---|
| 77,602 | 5/1868 | Floyd . | |
| 440,690 | 11/1890 | Bevin . | |
| 490,269 | 1/1893 | Chisholm . | |
| 893,878 | 7/1908 | Shires . | |
| 1,195,027 | 8/1916 | Jones | 239/136 |
| 1,238,861 | 9/1917 | Williams et al. . | |
| 2,597,719 | 5/1952 | Foster . | |
| 2,890,970 | 6/1959 | Allen | 239/136 |
| 3,004,273 | 10/1961 | Rushmer | 15/55 |
| 3,103,897 | 9/1963 | Bonnano et al. . | |
| 3,712,242 | 1/1973 | Bertin | 104/279 |
| 4,023,286 | 5/1977 | Wickware | 37/14 |
| 4,230,045 | 10/1980 | Fearon | 104/279 |
| 4,240,667 | 12/1980 | Sedlaczek et al. | 299/43 |
| 4,334,596 | 6/1982 | Lounsberry, Jr. | 184/3 |
| 4,856,617 | 8/1989 | Lounsberry, III et al. | 184/3.1 |
| 5,220,935 | 6/1993 | Bailey et al. | 134/102.1 |
| 5,348,120 | 9/1994 | Junk et al. | 184/3.1 |
| 5,381,958 | 1/1995 | Kobmüller et al. | 239/136 |
| 5,394,958 | 3/1995 | Junk et al. | 184/3.1 |
| 5,641,037 | 6/1997 | Wise et al. | 184/3.1 |
| 5,687,814 | 11/1997 | Craig et al. | 184/3.2 |

*Primary Examiner*—Stephen Avila
*Assistant Examiner*—Lars A. Olson
*Attorney, Agent, or Firm*—Pollock, Vande Sande & Amernick

[57] ABSTRACT

A track cleaning system mounted on a railcar and comprising track rail cleaning nozzles, leaf removal nozzles and third rail cleaning nozzles. Each of the nozzles may provide a fan-shaped spray pattern diverging to either side of a central axis and having a major axis. For each track rail nozzle, the central axis may be perpendicular to a horizontal top rail surface and the major axis may be perpendicular to the rail surface centerline. For each leaf nozzle, the central axis may be directly downwardly from the horizontal and the major axis may be parallel to an elongated spray bar on which one or more leaf nozzles are mounted. For each third rail nozzle, the central axis may be directed downwardly from the horizontal and the major axis may be positioned vertically. The third rail nozzles may be mounted to the rear of the leaf nozzles to aid in leaf removal. Main water valves are remotely actuated by air to release high pressure water to corresponding sets of nozzles. A pressure control valve controls the pressure of water supplied to the main water valves from a positive displacement, high pressure water pump.

24 Claims, 9 Drawing Sheets

RAILCAR TRACK CLEANING SYSTEM

TECHNICAL FIELD

This invention relates to debris removal systems for rail tracks, and more particularly to a railcar mounted system for removing leaves, leaf resins, snow, ice, oil, grease and other deposits from on and around railroad switches and railroad tracks.

BACKGROUND OF THE INVENTION

Loss of adhesion between the wheels of railroad locomotives and the rails on which the locomotives ride may be caused by the accumulation of leaves, leaf resins, snow, ice, oil, grease and other deposits on the rails. Such deposits may also occur in nearby locations from which they may be blown onto the rails by air currents. Low adhesion conditions require the expenditure of more locomotive power with a corresponding loss in economy, or may seriously reduce the effectiveness of breaking actions of the locomotive and/or the railcars pulled by the locomotive.

While sand has been used in the past to increase wheel-to-rail adhesion during slippery rail conditions, the use of sand is both uneconomical and damaging to railroad equipment. For example, the use of sand requires building and maintaining expensive handling facilities, and the use of sand is detrimental to the rails and wheels of locomotives and railcars due to abrasive effects when sand comes between moving mechanical parts.

One past solution to reduce the loss of adhesion has been to spray strong oil and grease removal compositions onto the rails for cleaning the rail surfaces that come into contact with the train wheels. However, this solution may be viewed with some disfavor because of increasing environmental awareness of the adverse consequences of using strong chemical agents for cleaning operations in the outdoor environment.

Various devices also have been tried for using fluids, such as air, water or steam, for cleaning the rails of railroads and the like. For example, U.S. Pat. No. 440,690 to Bevin describes a device for removing sand from the rails immediately after the driving wheels of a locomotive have passed over the sand by blowing air under pressure against the rails. U.S. Pat. No. 77,602 to Floyd describes a device for applying a jet of steam against the rails by means of a nozzle in front of the wheels of a locomotive to remove snow, ice, oil, grease or other deposits interfering with the adhesion between the wheels and the rails. U.S. Pat. No. 5,381,958 to Koblmuller, et al. describes an apparatus for destroying unwanted vegetation by directing jets of steam between and along side of the rails of a railway. U.S. Pat. No. 1,238,861 to William et al., U.S. Pat. No. 893,878 to Shires, U.S. Pat. No. 2,597,719 to Foster, and U.S. Pat. No. 4,023,286 to Wickware describe devices for directing air onto rail surfaces in such a way as to remove ice, snow, and other foreign matter. U.S. Pat. No. 4,230,045 to Fearon describes a method and system for increasing track-to-wheel adhesion by spraying high pressure water mixed with cleaning agents onto wheel contact surfaces of the rail forward of the driving wheels of a locomotive. U.S. Pat. No. 490,269 to Chisholm describes a device for removing dust and debris from electrified rails by directing air onto the track surface directly in front of the wheels of a self-propelled car.

While the foregoing devices may have some capacity for removing snow, ice and other debris from the rails of a railway, there is still a need for a more effective device of less complexity and greater economy. A particularly difficult deposit to remove are leaf resins that become imbedded in the pores of rail surfaces as leaves falling on the tracks are ground between the rails and the wheels of heavy locomotives and railcars. There is also a need for a track cleaning device that improves efficiency and economy while providing excellent environmental compatibility.

SUMMARY OF INVENTION

The present invention overcomes the deficiencies of the prior art by providing an efficient, effective and self-contained railcar mounted unit for removing the above indicated types of debris from railroad track systems. The unit employs high pressure water ejected through a variety of nozzles arranged in special arrays to remove leaves, oil and grease, resin coatings deposited by leaves and embedded in porous rail surfaces, snow and ice, and other debris from rails at speeds up to about 30 to 40 miles per hour. A crewman sitting at an operator console located in a cab at the front of the railcar carrying the unit has complete control of the system. The controls provided at this operator station provide for directing water energy onto rail surfaces and other areas of the railway right-of-way, and for reducing the energy of the discharges by shunting water to various combinations of nozzles at intersections and in congested areas.

The unit employs a fixed displacement pump, such as one rated at 56 gallons per minute (gpm) at 13,000 pounds per square inch (psi), and appropriately sized nozzles to transform the energy from a combustion engine, such as a 500 horse power (hp) diesel engine, into kinetic water energy for impacting and removing debris from the rails. A water tank provides a reservoir with sufficient water for continuous operation of the unit for a selected time period, such as 10,000 gallons of water for approximately three hours of continuous operation. The pressure of the discharge water system is preferably controlled by regulating nitrogen pressure that opposes water pressure across a diaphragm in the actuator of a bypass control valve in a recycle line. Excess water from the pump released by the control valve is recycled back to the reservoir tank through the recycle line.

The high pressure water system employs the following four separately controlled sets of nozzles: (1) right and left leaf clearing nozzles, (2) right and left track rail cleaning nozzles for removing embedded leaf resins and oil and grease residues, (3) left side third rail nozzles for snow and ice removal from a left side electric third rail, and (4) right side third rail nozzles for snow and ice removal from a right side electric third rail. The number and size of nozzles in each set are selected to provide the maximum cleaning action for the particular cleaning function of each set, based on the entire pump volume being discharged through only one set of nozzles at a time.

Operation of each set of nozzles is controlled by a corresponding individual air activated water control or stop valve. Preferably, this water valve is either fully open or fully closed. A solenoid air valve in its open position allows air to pressurize a piston and cylinder assembly mechanically attached as the actuator for this high pressure water valve. The solenoid actuator of the air valve is electrically connected to an on/off switch on the operator console. As the piston in the cylinder extends, the water valve opens to allow water to flow to and through the corresponding set of nozzles. Opening additional water control valves in the same manner allows high pressure water to flow through other sets of nozzles, which reduces the energy level of the water spray discharged by any one set of nozzles. Thus, the more water control valves opened, the less will be the water impact energy available from any one set of nozzles.

Although additional third rail nozzles may be used in each set, the two third rail sets of nozzles are each preferably a single nozzle directed laterally and angled down slightly, preferably 2–15° and more preferably 5–10°, to remove snow and ice from an electrified third rail of the type that provides the energy for electric trains. Each third rail nozzle is controlled by a separate air valve. With only one third rail nozzle operating on each side of the railcar, enough water impact energy may be provided to move out of the way medium size tree branches, as well as to provide some leveling of the rail ballast in the areas between the tracks and between the track rails and the third rails.

One of the prior art problems encountered with using compressed air to clear leaves from railroad tracks was that leaves initially blown clear of the tracks would be drawn back onto the tracks by the turbulence created by the railcar motion. The present invention solves this problem by providing for the simultaneous operation of the leaf clearing nozzles and both third rail nozzles. Reducing energy at the leaf clearing nozzles causes less swirling of the leaves, and placement of the third rail nozzles behind the leaf clearing nozzles by a preselected number of feet, depending on the railcar speed, catches the leaves in mid-air and continues to direct them further from the railcar and beyond the reach of its own turbulence.

Another problem encountered in the prior art with the use of pressurized air and/or water to clean rail surfaces was that the impact energy of the fluid stream at the rail surface was insufficient to remove tightly adhering deposits such as embedded leaf resins and hardened grease and/or oil deposits. To solve this problem, the track rail cleaning nozzles of the present invention are located close to the top surface of the rail and the water blast is concentrated on only that portion of the top surface of the rail that comes into contact with the wheels of the train. For this reason, the discharge orifices of the track rail cleaning nozzles are located above the top surface of the rail by about 1–5 inches, preferably 2–4 inches, and more preferably about 2½ inches for a spray pattern that diverges from the orifice at about 15° (i.e. preferably using a 15° nozzle). This provides a high concentration of water impact energy where it is most critical for the rails to be resin and oil free.

The number of track rail cleaning nozzles on each side of the rail car may be varied depending on the specific application, this number usually being 1–4 per side or a total 2–8 nozzles, 2 per side being the most preferred for relatively heavy coatings of embedded leaf resins and/or solidified oil or grease deposits. Where two nozzles per side are used, they are preferably offset by about one-fourth to three-eights inch on opposite sides of the rail surface centerline. Although not needed for many applications, a cleaning or degreasing agent may be added to the water reservoir to aid in the removal of certain grease and oil residues.

BRIEF DESCRIPTION OF THE DRAWINGS

The invention, both as to its structure and operation, may be further understood by reference to the detailed description below taken in conjunction with the accompanying drawings in which.

BEST AND VARIOUS MODES FOR CARRYING OUT THE INVENTION

Figure 1:
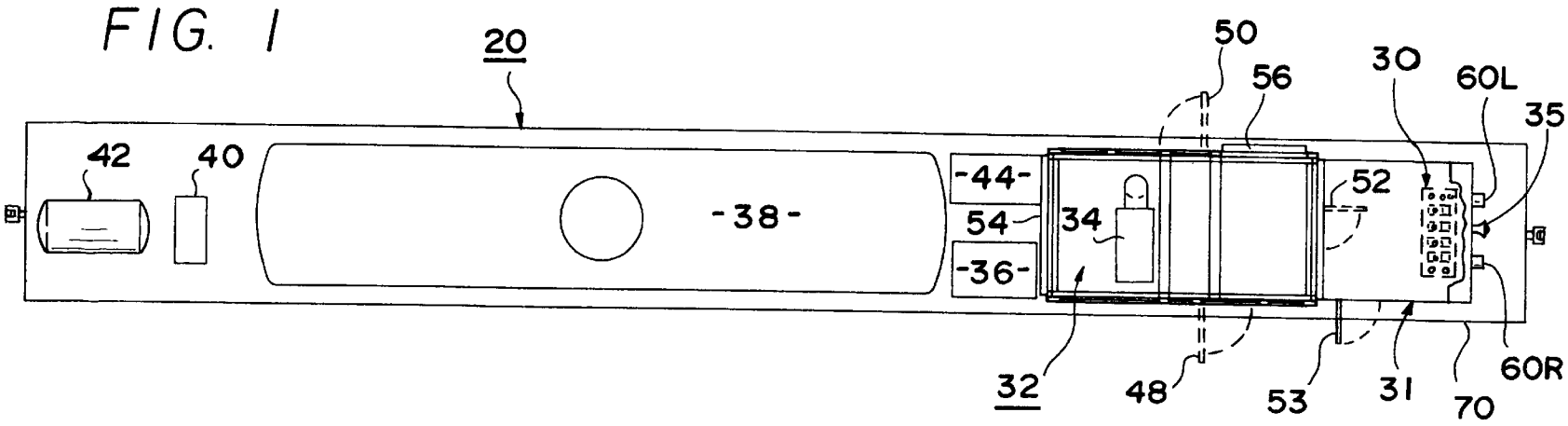
FIG. 1 is a top plan view of a railcar having components of the invention mounted thereon.
Figure 2:
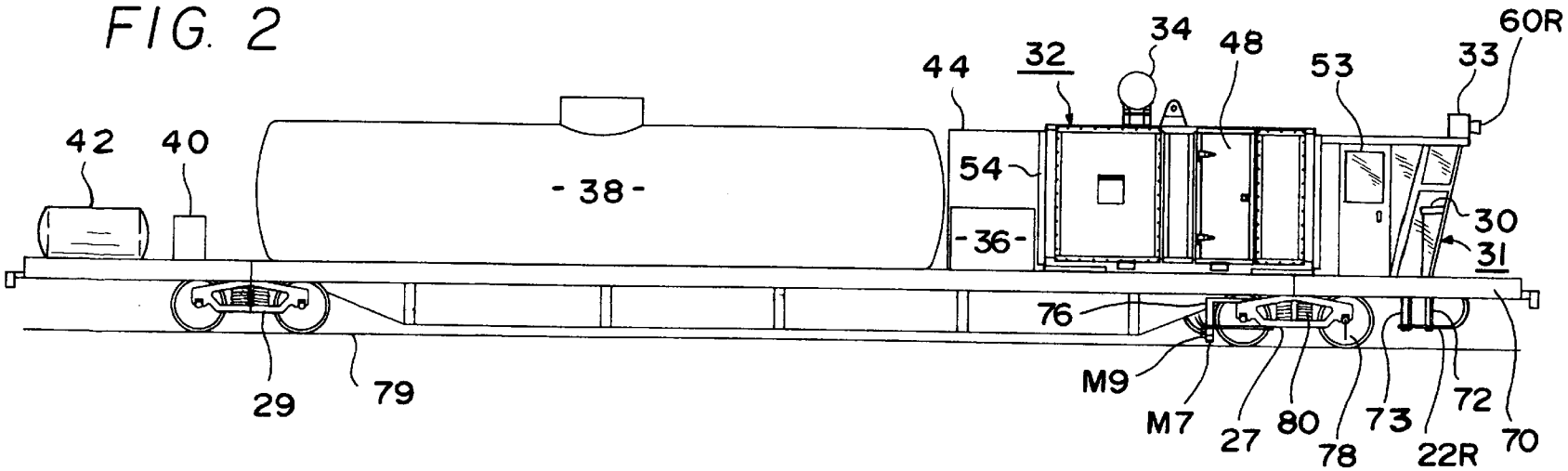
FIG. 2 is an elevational view of the railcar of FIG. 1.

To facilitate a better understanding of the structure and operation of the present invention, reference is made to FIGS. 1–4 in which are shown some of the major components of the invention mounted on the body of a railcar 20. The components shown in these figures include right and left side leaf spray bars 22R and 22L, each carrying three (3) nozzles N1–N3 and N4–N6, respectively, a pair of right side track rail cleaning nozzles 24R and 26R and a pair of left side track rail cleaning nozzles 24L and 26L on the front wheel truck 27 of the railcar 20, right and left side third rail cleaning nozzles 28R and 28L also on front wheel truck 27, an operator console 30 in a front operator cab 31, a pump and engine compartment 32 on the roof of which is mounted an engine silencer 34, an engine fuel tank 36, a water storage tank or reservoir 38, an air compressor 40, a compressed air tank 42, and a valve compartment 44.

The pump and engine compartment 32 has a right outside door 48 and a left outside door 50, and a front inside door 52 leading to the operator cab 31, which also has a right outside door 53. The enclosure defining the pump and engine compartment 32 also includes an air inlet louver 54 and an air outlet louver 56, the purpose of which will be described below in connection with the engine component in the compartment 32. The operator console 30 will also be described further below. For night time operations, a pair of headlights 60R and 60L may be mounted on a housing 33 at the front of the operator cab 31, and the housing may also include a horn 35 for use anytime.

The leaf spray bars 22R and 22L are suspended from the body of the railcar 20 near the front end of its platform 70 by a pair of brackets 72 and 73. The track rail cleaning nozzles 24R, 24L, 26R and 26L, and third rail cleaning nozzles 28R and 28L, are mounted at the rear of the front wheel truck 27 by means of a mounting frame 76. Rotatably mounted in the usual fashion on front truck 27 are 4 front wheels 78 for engaging a pair of track rails 79. The railcar bed 70 is resiliently carried by the front wheel truck 27 and a rear wheel truck 29 by means of coil springs 80.

Figure 3:
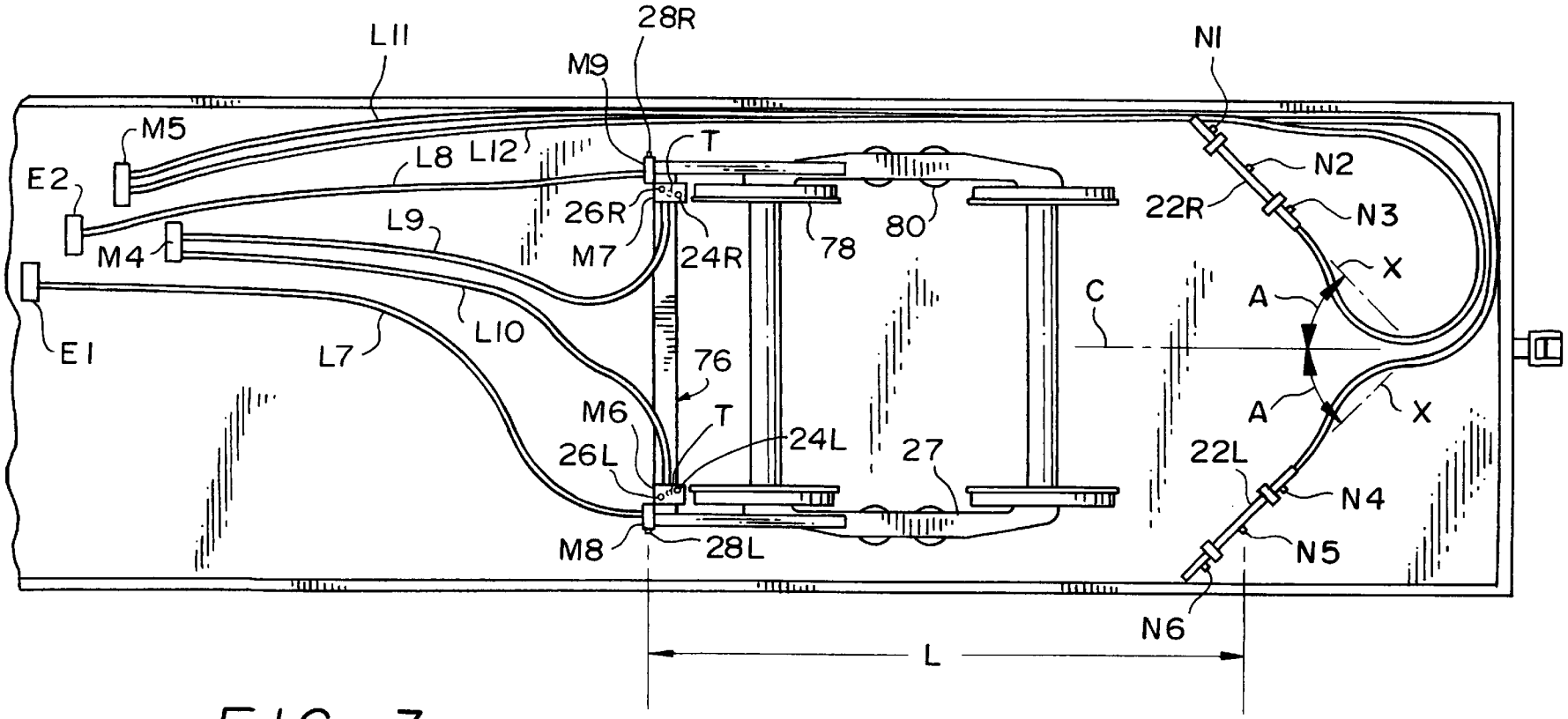
FIG. 3 is a fragmentary bottom plan view of the railcar of FIGS. 1 and 2.
Figure 4:
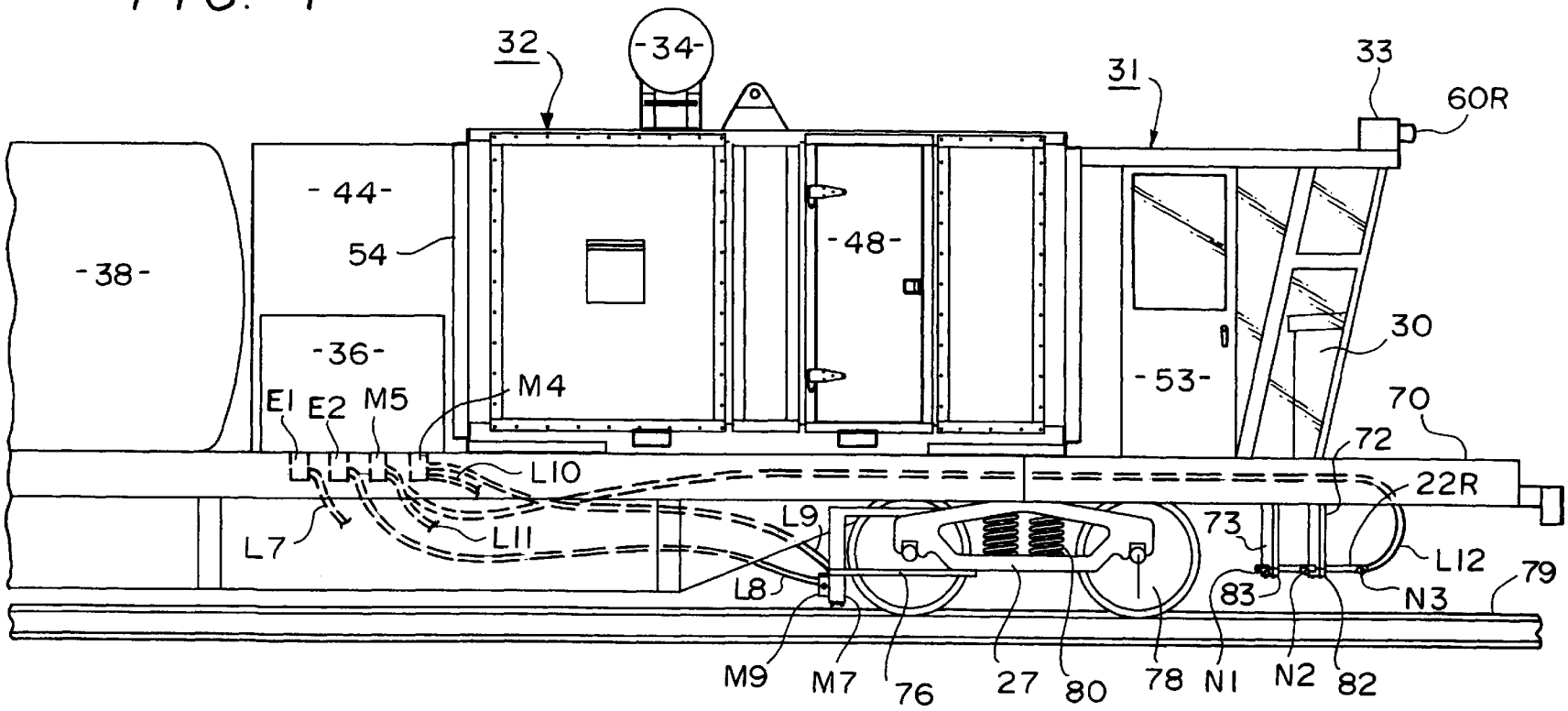
FIG. 4 is a fragmentary elevational view of the railcar of FIGS. 1 and 2.
Figure 5:
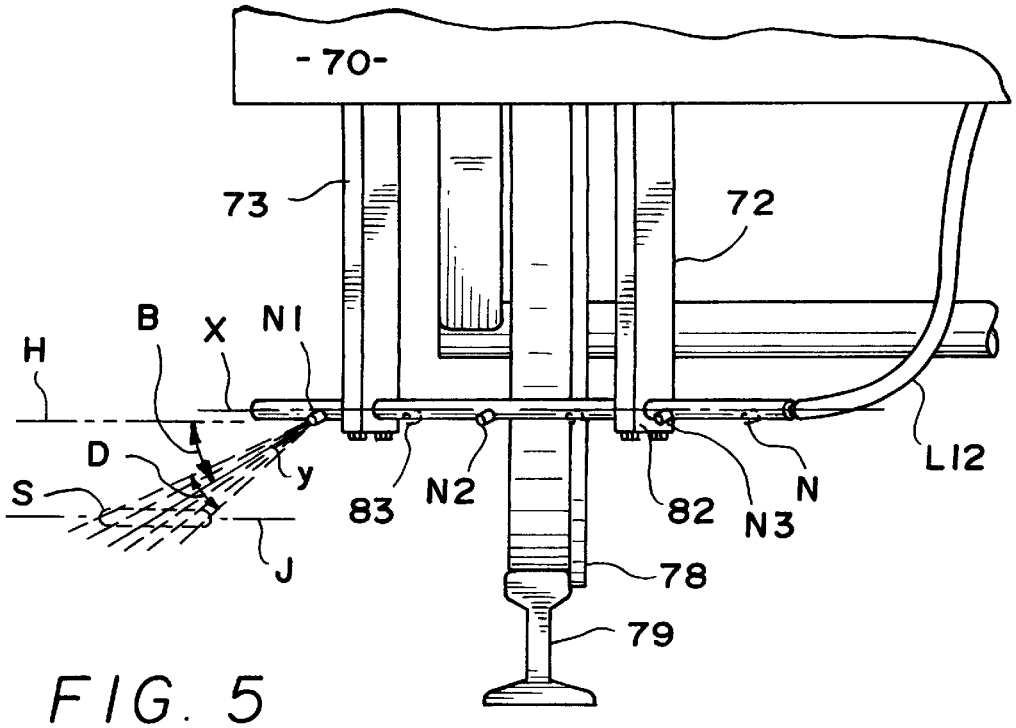
FIG. 5 is a fragmentary front elevational view of the right side leaf clearing nozzles of FIGS. 3 and 4.

Referring now to FIGS. 3–6, the longitudinal axis X of each of the spray bars 22R and 22L is preferably horizontal and mounted at an angle A relative to the center line C of the railcar, the angle A preferably being the range of 30–60°, more preferably being about 45°. Each of the spray bars preferably carries one or more high pressure water nozzles, such as nozzles N1–N3 and nozzles N4–N6, the number of these nozzles being variable depending on the application. The preferred number of these nozzles is in the range of 1–6, more preferably 3 on each spray bar as shown in FIGS. 3 and 4, the three nozzles on each bar being preferably spaced about 12 inches apart. An additional three nozzles per bar are shown by phantom outlines N in FIG. 5. In applications where six nozzles are used on each spray bar, they are preferably spaced 6 inches apart.

Each of the brackets 72 and 73 include an end clamping piece 82 and 83, respectively, so that the spray bar may be rotated and clamped at different rotational positions. Thus, the nozzles can be directed downwardly from the horizontal plane H at different angles B, the preferred angle being the range of 15–45°, more preferably about 30°, as measured from the horizontal plane H to the central axis Y of the water spray pattern S in the vertical plane containing the axis Y.

Each of the nozzles of the present disclosure is preferably a nozzle providing a fan-shaped spray having an overall divergence angle D and a flat oval transverse cross section with a relatively large major axis J and a relatively small minor axis (thickness). The overall divergence angle D is preferably in the range of 7° to 30° and more preferably 10° to 20°; the most preferred angle being substantially 15°. Thus, the divergence angle D of the water spray from the leaf nozzles is preferably about 15°, i.e. diverging at an angle of about 7½° relative to its central axis Y in the plane of its major axis J. The major axis J of the fan-shaped spray is preferably substantially parallel to the horizontal spray bar axis X as shown diagrammatically in FIG. 5. Each spray bar is preferably mounted about 6–18 inches, more preferably about 12 inches, above the top surface of the corresponding track rail.

Figure 6:
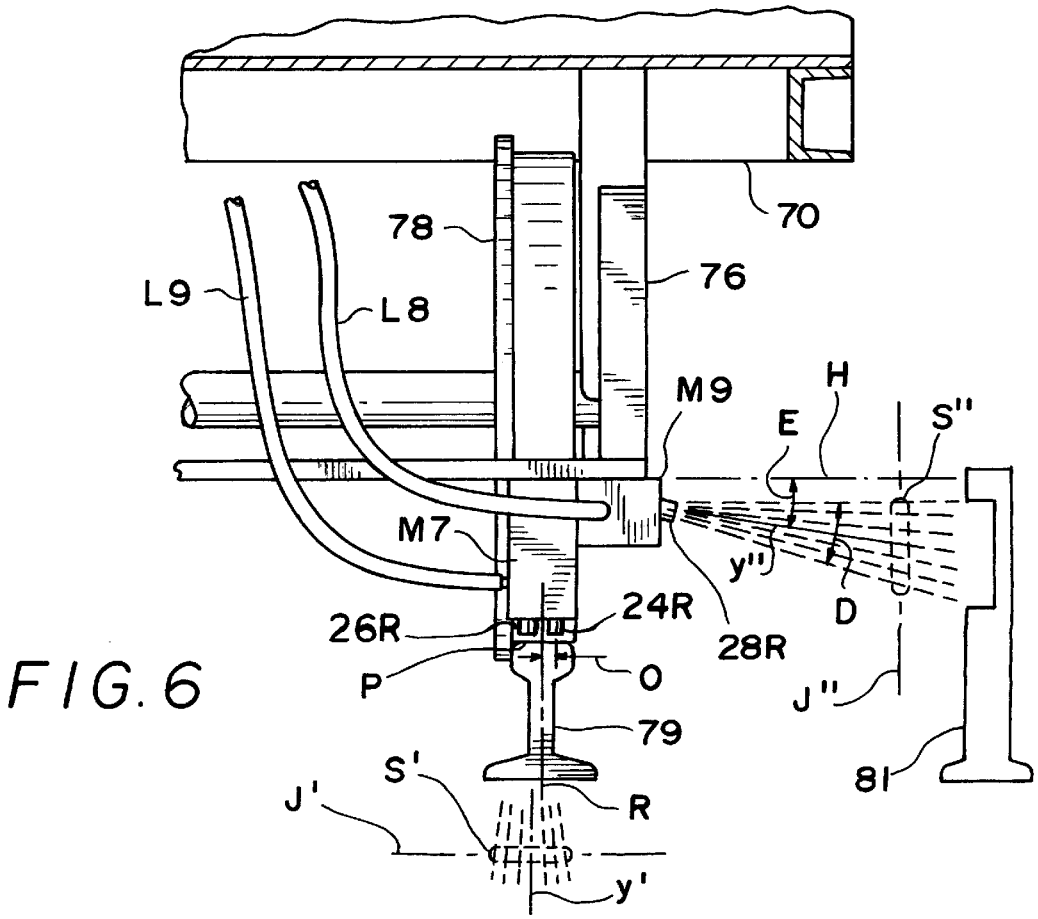
FIG. 6 is a fragmentary rear elevational view of the right side and third rail cleaning nozzles of FIGS. 3 and 4.

Although one or more than two track rail cleaning nozzles may be employed, there are preferably two nozzles on each side of the railcar as shown in FIG. 6. The possibility of a centrally located third track rail cleaning nozzle is indicated by phantom lines T in FIG. 3. These rail cleaning nozzles are preferably located 1–5 inches, more preferably 2–4 inches, and most preferably about 2.5 inches above the top surface of the rail. These nozzles also preferably have a fan-shaped spray pattern S' diverging at 15° with the major axis J' of this spray substantially perpendicular to the rail surface center line R as illustrated diagrammatically for nozzle 26R in FIG. 6. Also, these nozzles are preferably arranged with their central axes at an offset distance O of one quarter to ⅜ inch on opposite sides of the rail surface center line R so as to confine the water blast to the center two-thirds of a horizontal portion P of the rail top surface, which is that portion of the surface engaged by the wheels of locomotives and railcars. The fan-sprays from nozzles 24L and 26L, and from 24R and 26R, preferably overlap slightly on the rail surface at the rail center line R.

With four track rail nozzles (2 per side) operating at a pump discharge pressure of 10,000 to 12,000 psi, the spray from each 15° nozzle will cover about 0.65 inch of rail width at a standoff of 2.5 inches between the nozzle orifice and the rail surface. In this application, each track rail nozzle is arranged so that the central axis Y' of its spray is substantially perpendicular to the horizontal portion P of the rail top surface. The frame 76 is mounted directly on the wheel truck 27, instead of on the railcar platform 70, so that the standoff between each nozzle orifice and the rail surface will be maintained precisely as the railcar travels along the railroad tracks.

Also mounted on the mounting frame 76 to the rear of the track rail cleaning nozzles are the right and left third rail cleaning nozzles 28R and 28L, which are preferably located 3–6 inches, more preferably 4–5 inches, and most preferably about 4.5 inches above the track rail surface. The nozzles 28R and 28L are preferably positioned to direct a diverging water spray laterally toward a corresponding electrified third rail 81 in the direction perpendicular to the direction of travel of the railcar. These nozzles also preferably have a fan-spray divergence D of about 15° when operated at a pressure of about 10,000 psi. For these nozzles, the major axis J" of the flat oval spray pattern S" is preferably aligned with the vertical as shown in FIG. 6. It is also preferred that the central axis Y" of the spray from these nozzles be directed downwardly at an angle E relative to the horizontal H, the angle E preferably being in the range of 2–12°, more preferably in the range of 5–10° and most preferably about 8°.

An important aspect of the invention is that the third rail cleaning nozzles 28R and 28L are located a significant distance L behind the leaf spray bars 22R and 22L, such that the nozzles 28R and 28L will help prevent leaves once blown clear of the tracks by the spray bars from being drawn back onto the track by the turbulence created by passage of the railcar. Thus, placement of the third rail nozzles 28R and 28L a distance L behind the midpoint or middle nozzle of the spray bars (FIG. 3) allows the spray from the third rail nozzles to catch in mid-air the leaves suspended by the spray from the spray bar nozzles and direct these leaves further away from the railcar so that they are out of reach of the turbulence created by the railcar passage. For railcar speeds in the range of 30 to 40 miles per hour, the distance L is preferably about 5–15 feet, more preferably 8–12 feet, and most preferably about 10.5 feet. It is also believed that the optimum position of the midpoint of each of the spray bars 22R and 22L is about 4.5 feet behind the front end of the railcar bed 70.

Figure 7:
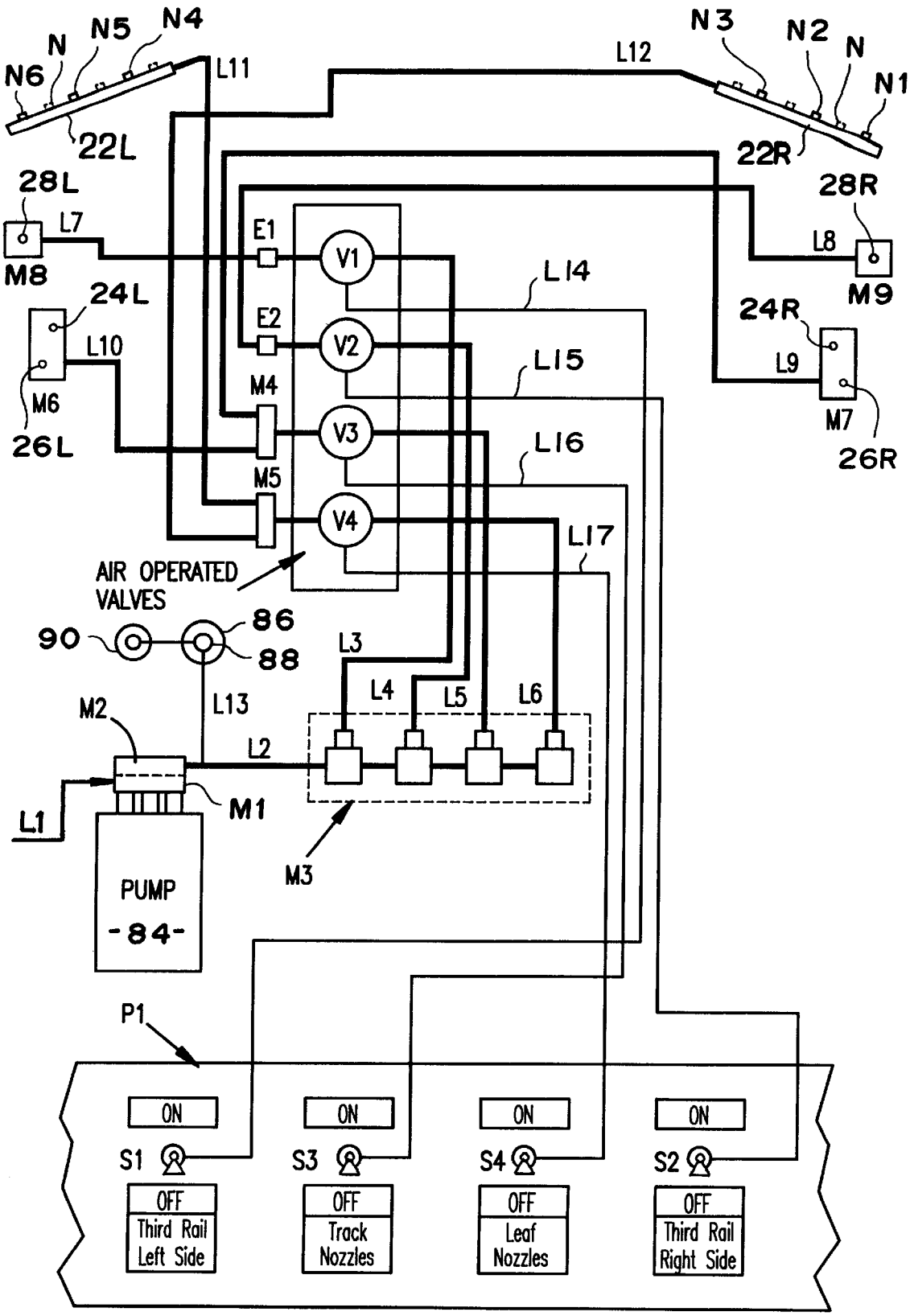
FIG. 7 is a diagram of the water and control air distribution systems of the invention.
Figure 8:
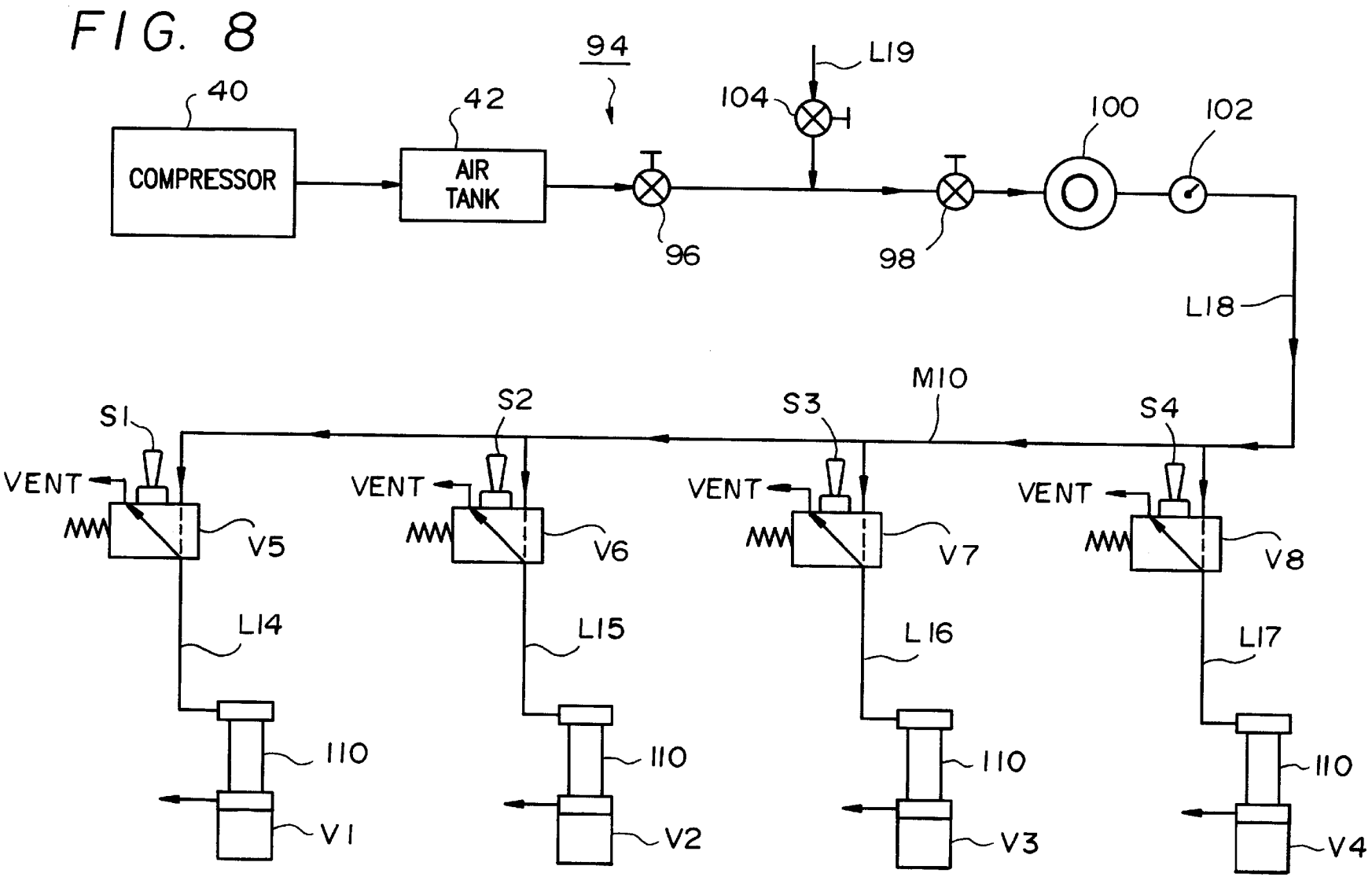
FIG. 8 is a diagram of the control air system providing pressurized air for the control air distribution system of FIG. 7.

Referring now to FIGS. 7 and 8, there are shown diagrams of the water distribution system for providing high pressure water to the nozzle 24R, 26R, 24L, 26L, 28R and 28L and to the spray bars 22R and 22L, and of the air system for providing pressurized air to remotely actuate the main high pressure water valves V1, V2, V3 and V4. Feed water from water storage tank 38 is fed through a line L1 to the inlet manifold M1 of a high pressure water pump 84, and high pressure water is discharged from the pump outlet manifold M2 through a line L2 to a distribution manifold M3. As will be described further below, the desired discharge pressure of the water in line L2 is maintained by a nitrogen regulated water pressure control valve 86 connected to the pump outlet manifold M2 by a line L13. The diaphragm chamber 88 of the water pressure valve is connected to a source of nitrogen pressure, such as a nitrogen bottle 90.

From distribution manifold M3, high pressure water is distributed to the air actuated main water valves V1, V2, V3 and V4 via lines L3, L4, L5 and L6, respectfully. Upon valve actuation, high pressure water is supplied by valve V1 to the third rail nozzle 28L through a line L7 containing an elbow E1, by valve V2 to the third rail nozzle 28R through a line L8 containing an elbow E2, by valve V3 to track rail nozzles 24R and 26R through a line L9 via a manifold M4, by valve V3 to track rail nozzles 24L and 26L through a line L10 via the manifold M4, by valve V4 to leaf nozzle bar 22L through a line L11 via a manifold M5, and by valve V4 to nozzle bar 22R through a line L12 via the manifold M5.

As illustrated diagrammatically in FIG. 8, air for operating the valves V1–V4 is supplied to their air actuators 110 respectively through air lines L14, L15, L16 and L17 in response to actuation of respective toggle switches S1, S2, S3 and S4 on the panel P1 of operator console 30. The control panel switches S1–S4 actuate respective solenoid operated air valves V5, V6, V7 and V8. The inlet sides of valves of V5–V8 are connected to an air distribution manifold M10 supplied with pressurized air by a line L18 from a pressurized air system, generally designated 94.

Figure 9:
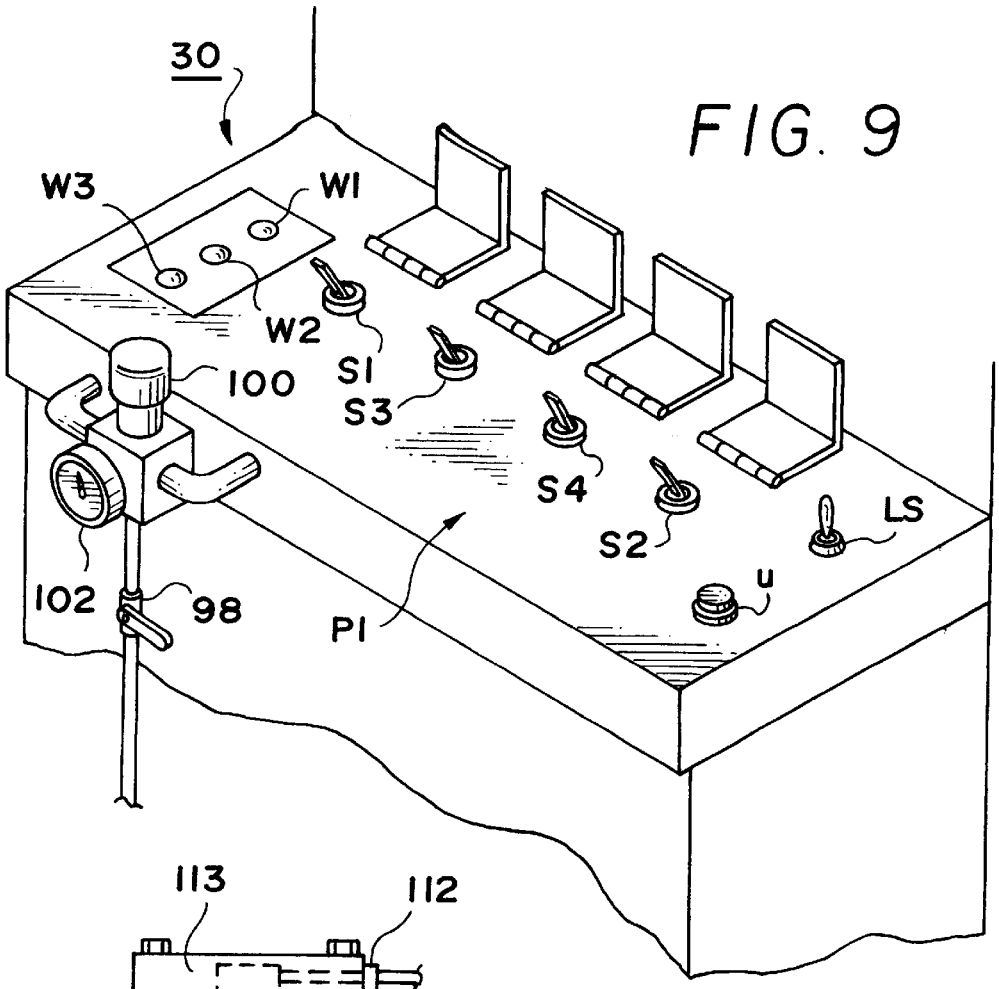
FIG. 9 is a perspective view of the operator console inside the operator cab of FIGS. 1 and 2.

Air system 94 comprises the air compressor 40, the compressed air tank 42, a shut off valve 96 near the air tank 42, a shut off valve 98, a pressure regulator 100 and a pressure gauge 102. An alternate source of air may be provided by connecting the train air system (not shown) to the track cleaning air system 94 via a line L19 connected to the air line between the shut off valves 96 and 98, line L19 containing a third shut off valve 104. The shut off valve 98, the regulator 100 and the pressure gauge 102 are preferably mounted on or adjacent to panel P1 of the operator console 30 as shown in FIG. 9. The panel P1 may also include a switch LS for operating lights 60R and 60L, a button U for operating horn 35, a green light W1 for indicating adequate water in tank 38, an amber light W2 for indicating a low water level, and a red light W3 for indicating inadequate water to keep pump 84 running.

Figure 10:
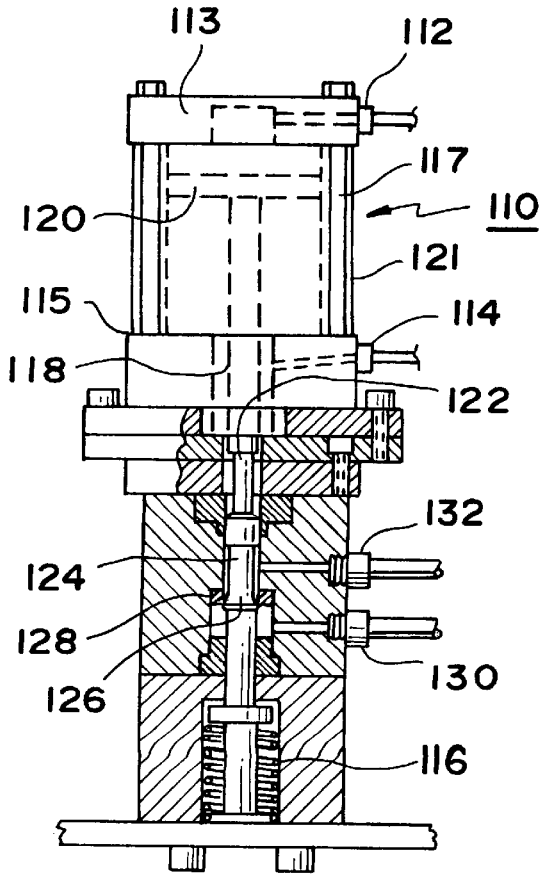
FIG. 10 is a partial sectional view of one of the air operated high pressure water control valves of FIG. 7.

Some of the internal elements of the air operated valves V1–V4 are shown in FIG. 10, which illustrates a partial sectional view of valve V1. Although other valve arrangements may be used, the valve shown by way of example is available from Butterworth Jetting Systems, Inc., is rated at 15,000 psi, and is supplied with a foot pedal actuator (not shown). For purposes of the present invention, the valve supplied was modified by replacing a foot petal actuator with an air piston and cylinder actuator 110 having an air inlet port 112, an air venting or exhaust port 114, a cylinder 121, and a piston 120 arranged to reciprocate in cylinder 121. Cylinder 121 may have a four inch bore and piston 120 a two inch stroke. Inlet port 112 is in an upper cylinder head 113 and the exhaust port 114 is in a lower cylinder head 115, the two heads being bolted together by a plurality of external bolts 117. The valve is held in its closed position by coil spring 116 and is opened by supplying pressurized air to air inlet port 112 through air supply line L14. The rod 118 of piston 120 has a reduced diameter segment 122 that engages the top of a valve shaft 124 to push the valve shaft downward against the tension of spring 116, so as to lower the conical valve element 126 away from the valve seat 128 and thereby open the valve so that pressurized water flows from water inlet 130 to water outlet 132.

Figure 11:
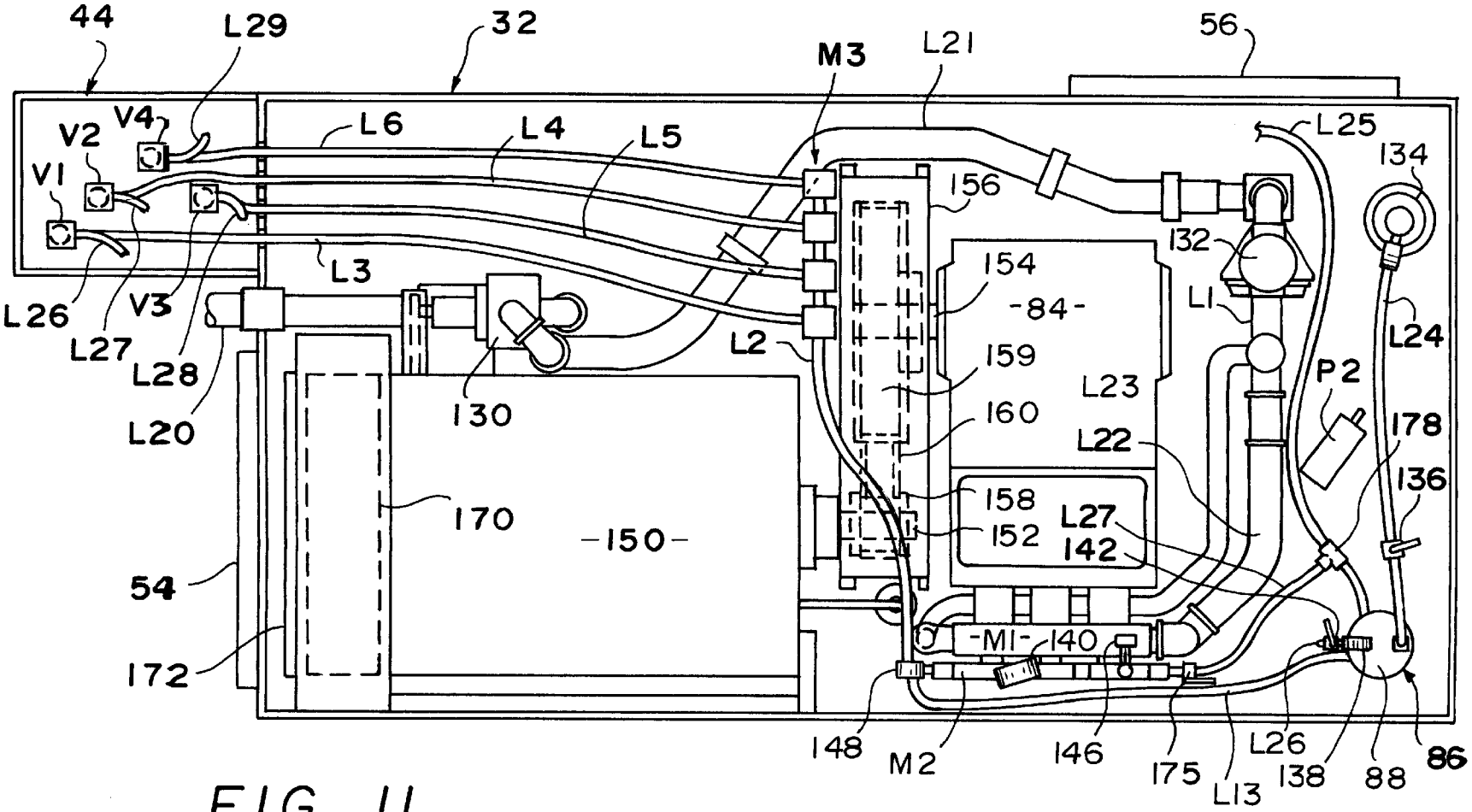
FIG. 11 is a plan view of the components enclosed within the pump and engine compartment and the water control valve compartment of FIGS. 1 and 2; and, FIG. 12 is an elevational view of the components within the compartments of FIG. 11.
Figure 12:
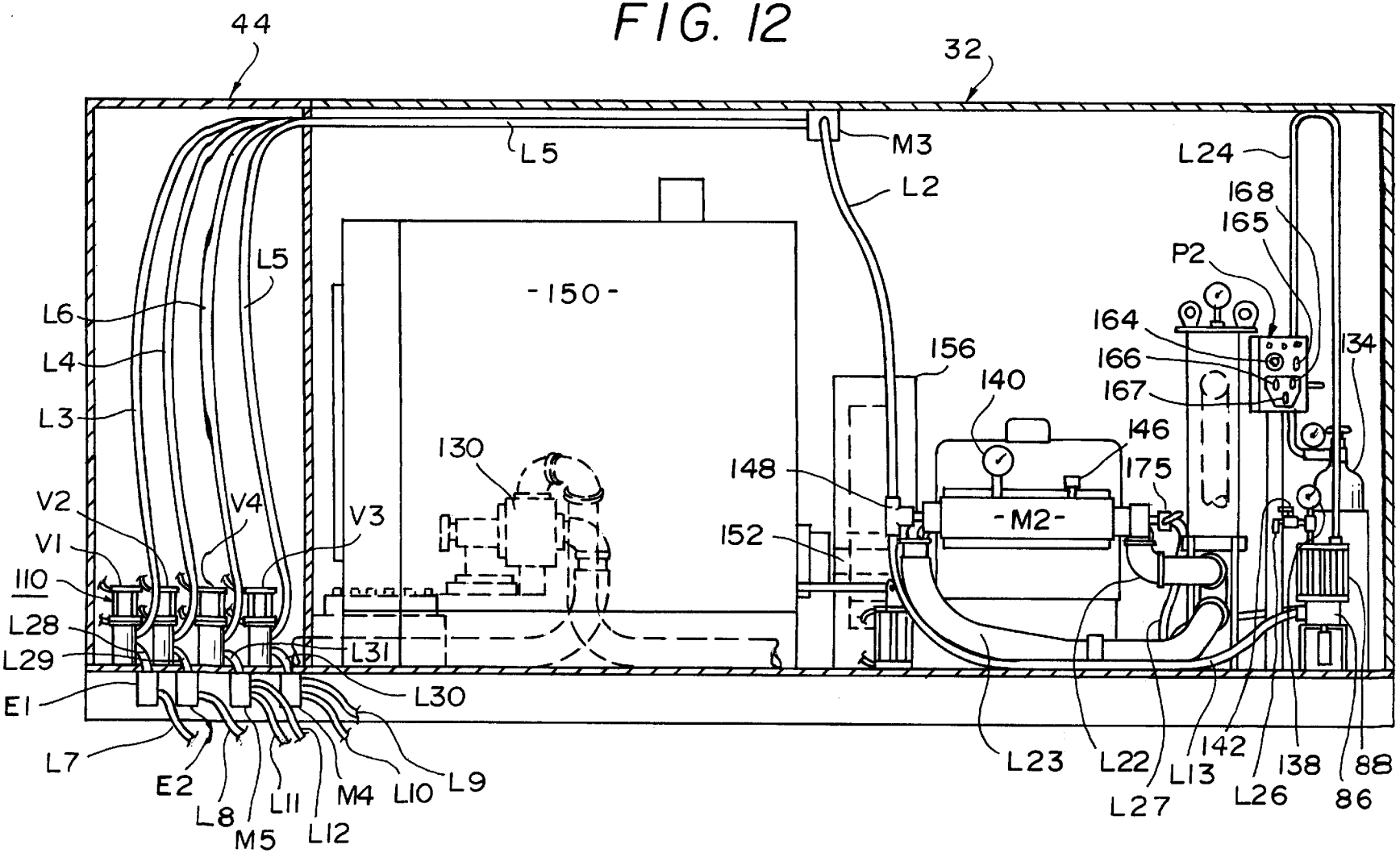

Referring now to FIGS. 11 and 12, there are shown the components in the pumping engine compartment 32 and in the valve compartment 44 for providing high pressure (8,000 to 12,000 psi) water to the rail nozzles and the leaf spray bars. Feed water is supplied from the storage tank 38 to a feed water pump 130 through a line L20, an example of the feed pump rating being 56 gallons per minute at 35 psi. The feed water pump may be driven by a combustion engine 150, along with the high pressure water pump 84. The feed water from pump 130 is discharged through a line L21 to a bag filter 132, which filters from the water suspended particles capable of causing wear to the high pressure pump 84. Filtered water from filter 132 is divided into two lines L22 and L23 connected to opposite sides of the pump inlet manifold M1.

In high pressure pump 84, the pressure of the water is increased to about 11,000 to 13,000 psi, depending on the nitrogen pressure applied to the diaphragm in the nitrogen cylinder 88 of the pressure control valve 86. The control valve nitrogen pressure is preferably set at a value that will provide about 12,000 psi water pressure by filling the nitrogen chamber of the nitrogen cylinder via a line L24 from a nitrogen bottle 134 until the desired water pressure is achieved. The line L24 contains a shut off valve 136 and cylinder 88 has a pressure gauge 138 and a bleed line L26 with a valve 142 for setting the nitrogen pressure. The inlet of the pressure control valve 86 is connected to the pump discharge manifold M2 by high pressure water line L13. The discharge manifold M2 also is connected to a water pressure gauge 140 and a rupture disk 146, which is preferably set to rupture at about 13,000 psi to prevent over pressurization of the discharge manifold and the components connected thereto. For use during pump startup, discharge manifold M2 is connected via a valve 175, a bypass line L27 and a tee 178 to a recycle line L25 connected to the storage tank 38 in order to return water to the storage tank without pressurizing the water side of control valve 86. When engine 150 and pump 84 reach operating conditions, valve 175 is then closed. Thereafter, when the water pressure in discharge manifold M2 reaches the pressure control valve setting (e.g. 12,000 psi), this pressure is maintained because the control valve will automatically open to discharge excess water to storage tank 38 through the recycle line L25. The pressure gauge 140 on discharge manifold M2 provides an indication of the pressure of the high pressure water as generated by the pump 84 and maintained by the control valve 86.

The high pressure water pump 84 may be part of a package available from Aqua-dyne, of Houston, Tex., and sold as high pressure water jet blaster model No. C500DS. This unit is supplied with a high pressure pump rated at 15,000 psi at 50.0 gpm, and with a combustion engine power source 150 having a drive shaft 152 connected to a pump drive shaft 154 by a pulley and belt drive system 156 having a drive pulley 158 connected to a driven pulley 159 by one or more belts 160. In the Aqua-dyne unit, the combustion engine 150 is designated as a 500 hp diesel engine and the pump 84 as a "C" Series Triplex Pump.

For use with the present invention, the unit as purchased is preferably modified by increasing the engine rpm so that the pump may run at a reduced pressure of 13,000 psi at a higher capacity rating of 56 gpm with the engine developing the same horsepower, namely about 500 hp. The Aqua-dyne unit may also include the feed pump 130 having a capacity of 56 gpm at 35 psi, and the bag filter 132, together with connecting conduits.

The diesel engine 150 is operated from a control panel P2 having a speed control knob 164, tachometer 165 and the usual gauges, including an engine water temperature gauge 166, an ammeter 167 and an engine oil pressure gauge 168. The engine is water cooled by a fan 170 pulling air through inlet louvers 54 and a radiator 172, the heated air then being discharged through outlet louvers 56. In the specification, the designated lines are conduits that may be provided by either rigid piping or flexible hoses of appropriate pressure ratings.

Both the line L2 to the overhead manifold M3 and the line L13 to water pressure control valve 86 are connected to the pump discharge manifold M2 by a T-connector 148. From the overhead distribution manifold M3, the high pressure water discharged by pump 84 is supplied to air operated valves V1–V4 which are mounted on the top surface of the railcar bed or platform 70 and enclosed in the valve compartment 44 to the left rear side of the pump and engine compartment 32 as shown in FIG. 12 and illustrated diagrammatically in FIG. 7. As shown in FIG. 12, the water distribution elbows E1 and E2 and the distribution manifolds M4 and M5 are located beneath the railcar platform, elbow E1 being connected to valve V1, elbow E2 being connected to valve V2, manifold M4 being connected to valve V3, and manifold M5 being connected to valve V4 by lines L28, L29, L30 and L31, respectively. As also illustrated in FIG. 7 and shown in FIG. 3 and at least partially in FIG. 4 (due to the nature of the elevation), elbow E1 is connected to third rail nozzle 28L, elbow E2 is connected to third rail nozzle 28R, manifold M4 is connected to track rail nozzles 24R, 26R, 24L and 26L, and manifold M5 is connected to spray bars 22L and 22R by the lines previously indicated.

The various high pressure nozzles employed in the track cleaning system of the invention may be obtained, for example, from Spraying Systems, Inc. of Wheaton, Ill., the high pressure nozzles of this company being designated as the MEG Series. As illustrated in FIG. 7, there are outlets for six nozzles along each leaf spray bar and outlets for three nozzles along the track rail nozzle manifolds M6 and M7, and one nozzle outlet in the third rail nozzle manifolds M8 and M9. Thus, while three nozzles on each leaf bar and two nozzles on each track rail manifold and one nozzle on each third rail manifold are preferred, for many applications other nozzle combinations are contemplated. The number of total nozzles to be supplied by the high pressure water system should be used as the basis for choosing the specific nozzles to be used in each application. The following Table I is a nozzle chart showing by way of example some of the various combinations possible for the number of nozzles in each of the nozzle sets, the nozzle number designated in this chart referring to a specific nozzle available from Spraying Systems, Inc.:

TABLE I

NOZZLE CHART FOR THE DIFFERENT NOZZLE SETS

| QTY PER SIDE | PRESSURE (PSI) | NOZZLE NO. | PUMP GPM |
|---|---|---|---|
| A. FOR LEAF BLOWER SPRAY BARS: | | | |
| 1 | 8,000 | 1520 | 56.4 |
| 2 | 9,700 | 1509 | 56.0 |
| 3 | 9,800 | 1506 | 56.4 |
| 4 | 7,800 | 1505 | 56.0 |
| 5 | 8,000 | 1504 | 56.0 |
| 6 | 10,000 | 1503 | 56.4 |
| B. FOR TRACK RAIL CLEANERS: | | | |
| 1 | 13,000 | 1515 | 54.0 |
| 2 | 12,500 | 1508 | 54.4 |
| 3 | 13,000 | 1505 | 54.1 |
| C. FOR THIRD RAIL CLEANERS: | | | |
| 1 | 5,000 | 1550 | 55.9 |
| 1 | 8,000 | 1540 | 56.4 |
| 1 | 13,000 | 1530 | 54.0 |

The pressures indicated in the above chart are based on the assumption that only the set of set of nozzles indicated on each side of the rail car are operating to discharge the entire quantity of high pressure water being produced by the high pressure pump identified above by way of example, i.e., a pump rated at 13,000 psi and 56 gpm driven by a 500 hp diesel. For example, with two spray bar nozzles No. 1520 (one per side), the pressure in discharge manifold M2 will be about 8,000 psi and each nozzle will be discharging about 28.2 gpm for a total pump output of 56.4 gpm. Depending on the application, the nozzle numbers needed may be different from those shown in the above chart. Of course, the output pressure of the high pressure pump 84 will also vary depending on the number of nozzle sets being operated simultaneously as shown by the two examples in Table II.

TABLE II

PERFORMANCE CHART FOR DIFFERENT NOZZLE SET COMBINATIONS

| | (PSI) | NOZZLE NO. | GPM/NOZZLE | GPM |
|---|---|---|---|---|
| A. LEAF BLOWER & THIRD RAIL NOZZLES COMBINED: | | | | |
| QTY LEAF NOZZLES | | | | |
| 6 (3 PER SIDE) | 940 | 1506 | 2.9 | 17.4 |
| QTY 3RD RAIL NOZZLES | | | | |
| 2 (1 PER SIDE) | 940 | 1540 | 19.4 | 38.6 |
| | | | TOTAL PUMP GPM = | 56.0 |
| B. LEAF BLOWER & TRACK RAIL NOZZLES COMBINED: | | | | |
| QTY LEAF NOZZLES | | | | |
| 6 (3 PER SIDE) | 2650 | 1506 | 4.95 | 29.7 |
| QTY TRACK CLEAN NOZZLES | | | | |
| 4 (2 PER SIDE) | 2650 | 1508 | 6.55 | 26.2 |
| | | | TOTAL PUMP GPM = | 55.9 |

Persons skilled in the art, upon learning of the present disclosure, will recognize that various modifications to the components and systems of the invention are possible without significantly affecting their functions. For example, the length and inside diameters of the various conduits and the sizes of the spray nozzle orifices and the number of spray nozzles in each set, may vary widely depending on the desired application and the specific manufacturer selected for each of the components. Also the leaf spray bars may be mounted on the front of the wheel truck 27 or elsewhere on the railcar, and the third rail nozzles may be mounted on the platform 70 or elsewhere on the railcar. Accordingly, while the preferred embodiments have been shown and described in detail by way of example, further modifications and embodiments are possible without departing from the scope of the invention as defined by the claims below.

What is claimed is:

1. A track cleaning system for a railcar having a truck with at least one wheel for engaging the rail of a track along which the railcar may travel, said system comprising:

at least two track rail nozzles each for discharging a water spray against a top surface portion of the same track rail;

means for mounting said track rail nozzles on said wheel truck; and, water supply means for providing pressurized water to said track rail nozzles;

said water spray being discharged along and diverging from a central spray axis, one of said track rail nozzles being positioned with its central spray axis offset to one side of a centerline of the top surface portion of the track rail and another of said track rail nozzles being positioned with its central axis offset to another side of said rail centerline opposite to said one side of said rail centerline, and said offset track rail nozzles being positioned sufficiently close to said top surface portion of the track rail that the water sprays from said track rail nozzles impact said top surface portion over a lateral distance less than a lateral distance between opposite edges of said top surface portion where said lateral distances are perpendicular to said rail centerline.

2. The track cleaning system of claim 1, wherein each of said track rail nozzles provides a fan spray pattern diverging from said central axis of the nozzle spray, and wherein said track rail nozzles are positioned so that the fan spray patterns overlap on said top surface portion of the track rail.

3. The track cleaning system of claim 2, wherein said central axis of each nozzle spray is substantially perpendicular to the top surface portion of the track rail, and wherein each of said fan spray patterns has a major axis extending substantially perpendicular to said rail centerline.

4. The track cleaning system of claim 2, wherein said water supply means is capable of providing pressurized water to said track rail nozzles at a pressure in the range of 8,000 to 15,000 psi.

5. A track cleaning system according to claim 1 further comprising an elongated leaf spray bar having a longitudinal axis positioned substantially horizontal and carrying at least one leaf nozzle for providing a water spray to remove leaves from around said track rail, and means for connecting said leaf nozzle to said water supply means through said leaf spray bar; and wherein said leaf nozzle provides a fan-shaped spray pattern diverging from a central spray axis and having a major axis substantially parallel to said spray bar axis.

6. The track cleaning system of claim 5, wherein the central axis of the spray pattern of said leaf nozzle is directed downwardly from the horizontal at an angle in the range of 15° to 45°.

7. A track cleaning system according to claim 5 further comprising a third rail nozzle for providing a water spray to remove debris from an electrified third rail adjacent to said track rail, and means for connecting said third rail nozzle to said water supply means; and wherein said third rail nozzle is positioned a sufficient distance behind said leaf nozzle relative to the direction and speed of railcar travel along said track rail that leaves suspended in air by the spray of said leaf nozzle are kept suspended in air by the spray of said third rail nozzle and are propelled further away from said track rail by said third rail spray.

8. The track cleaning system of claim 7, wherein said third rail nozzle provides a fan-shaped spray pattern diverging away from a central spray axis and having a major axis positioned in a substantially vertical direction.

9. The track cleaning system of claim 8, wherein the central axis of said third rail nozzle is directed downwardly from the horizontal at an angle in the range of 2° to 12°.

10. The track cleaning system of claim 1, wherein the central axis of the spray pattern of each of said track rail nozzles is offset from said rail centerline by a distance in the range of about ¼" to ⅜, and wherein the impact of the spray from said nozzles is confined to substantially the center two-thirds of the lateral distance between the opposite edges of said top surface portion of the track rail.

11. The track cleaning system of claim 1, wherein each of said track rail nozzles provides a fan-shaped spray pattern having an overall divergence of about 15°.

12. The track cleaning system of claim 5, wherein said leaf nozzle provides a fan-shaped spray pattern having an overall divergence of about 15°.

13. The track cleaning system of claim 7, wherein said third rail nozzle provides a fan-shaped spray pattern having an overall divergence of about 15°.

14. A track cleaning system according to claim 1, wherein said water supply means comprises a high pressure water pump, a combustion engine arranged to drive said high pressure water pump, a feed water pump for providing feed water to said high pressure water pump from a water reservoir, a filter for ensuring the cleanliness of water provided to said high pressure water pump by said feed water pump, and a water pressure control valve connected to the output of said high pressure water pump and to said water reservoir to control the output pressure of said high pressure water pump by diverting water to said reservoir when said output pressure exceeds a predetermined set pressure established by gas pressure applied to a gas cylinder of said water pressure control valve.

15. The track cleaning system of claim 14, wherein high pressure water output by said high pressure water pump is supplied to said track rail nozzles through a stop valve actuated between closed and open positions by a gas operated actuator connected for remote operation to a control gas system.

16. A track cleaning system according to claim 15, wherein said control gas system comprises a source of pressurized gas, a gas pressure regulator for controlling the pressure of said pressurized gas, a manifold for receiving pressurized gas from said pressure regulator, and a solenoid actuated gas valve for supplying pressurized gas to said gas operated actuator in response to operation of a switch on a control console.

17. A track cleaning system for a railcar having a truck with at least one wheel for engaging the rail of a track along which the railcar may travel, said system comprising:

an elongated leaf spray bar and having at least one leaf nozzle for providing a water spray to remove leaves from around said track rail, said leaf nozzle being arranged to receive pressurized water through said leaf spray bar;

a side nozzle for providing a lateral water spray to remove debris from a side area adjacent to said track rail, said side nozzle being positioned at a sufficient distance behind said leaf nozzle relative to the direction and speed of railcar travel along said track rail that leaves suspended in air by the spray of said leaf nozzle are kept suspended in air by the spray of said side nozzle and are propelled laterally further away from said track rail by said side nozzle spray; and, water supply means for providing pressurized water to said nozzles.

18. A track cleaning system according to claim 17 further comprising at least two track rail nozzles each for discharging a water spray against a top surface portion of the same track rail, and means for mounting said track rail nozzles on said wheel truck.

19. The track cleaning system of claim 17, wherein said leaf spray bar has a longitudinal axis positioned substantially horizontal, wherein said leaf nozzle provides a fan-shaped spray pattern diverging from a central spray axis and having a major axis substantially parallel to said spray bar axis, and wherein said side nozzle provides a fan-shaped spray pattern diverging away from a central spray axis and having a major axis positioned in a substantially vertical direction.

20. A track cleaning system according to claim 17 further comprising:

at least two track rail nozzles each for discharging a water spray against a top surface portion of the same track rail; and, means for mounting said track rail nozzles on said wheel truck;

said water supply means including means for providing pressurized water to said track rail nozzles;

and said water spray being discharged along and diverging from a central spray axis, one of said track rail nozzles being positioned with its central spray axis offset to one side of a centerline of the top surface portion of the track rail and another of said track rail nozzles being positioned with its central axis offset to another side of said rail centerline opposite to said one side of said rail centerline, and said offset track rail nozzles being positioned sufficiently close to said top surface portion of the track rail that the water sprays from said track rail nozzles impact said top surface portion over a lateral distance less than a lateral distance between opposite edges of said top surface portion where said lateral distances are perpendicular to said rail centerline.

21. The track cleaning system of claim 17, wherein each of said track rail nozzles provides a fan spray pattern diverging from said central axis of the nozzle spray, and wherein said track rail nozzles are positioned so that the fan spray patterns overlap on said top surface portion of the track rail.

22. The track cleaning system of claim 17, wherein the side area includes an electrified third rail alongside said track rail, and said lateral water spray is arranged to remove debris from said third rail.

23. A track cleaning system for a railcar having a truck with at least one wheel for engaging the rail of a track along which the railcar may travel, said system comprising:

at least two track rail nozzles each for discharging a water spray against a top surface portion of the same track rail;

means for mounting said track rail nozzles on said wheel truck; and, water supply means for providing pressurized water to said track rail nozzles;

said water spray being discharged along and diverging from a central spray axis, such that said track rail nozzles provide diverging spray patterns, and said track rail nozzles being positioned so that the diverging spray patterns overlap on said top surface portion of the track rail.

24. The track cleaning system of claim 23, wherein one of said track rail nozzles is positioned with its central spray axis offset to one side of a centerline of the top surface portion of the track rail and another of said track rail nozzles is positioned with its central axis offset to another side of said rail centerline opposite to said one side of said rail centerline, and wherein said offset track rail nozzles are positioned sufficiently close to said top surface portion of the track rail for the water sprays from said track rail nozzles to impact said top surface portion over a lateral distance less than a lateral distance between opposite edges of said top surface portion where said lateral distances are perpendicular to said rail centerline.

* * * * *